US008313220B2

(12) United States Patent
Chang

(10) Patent No.: US 8,313,220 B2
(45) Date of Patent: Nov. 20, 2012

(54) LED LIGHTING FIXTURE

(75) Inventor: Ko-Ning Chang, Kaohsiung (TW)

(73) Assignee: Taiwan Jeson Intermetallic Co., Ltd., Chiayi (TW)

( * ) Notice: Subject to any disclaimer, the term of this patent is extended or adjusted under 35 U.S.C. 154(b) by 603 days.

(21) Appl. No.: 12/536,630

(22) Filed: Aug. 6, 2009

(65) Prior Publication Data

US 2011/0032714 A1 Feb. 10, 2011

(51) Int. Cl.
*F21V 29/00* (2006.01)

(52) U.S. Cl. ..... 362/373; 362/294; 362/311.02; 362/547; 257/714; 257/715

(58) Field of Classification Search ..... 362/97.3, 362/218, 249.02, 294, 311.02, 373, 545, 362/547, 800; 257/714, 715
See application file for complete search history.

(56) References Cited

U.S. PATENT DOCUMENTS 7,095,110 B2 * 8/2006 Arik et al. ..... 257/712
7,784,962 B2 * 8/2010 Hockel et al. ..... 362/147
* cited by examiner

*Primary Examiner* — Stephen F Husar
(74) *Attorney, Agent, or Firm* — Ladas & Parry LLP

(57) ABSTRACT

A light emitting diode (LED) lighting fixture includes a lamp housing including a heat conductive cover, and a light transmissive shield connected detachably to a periphery of the heat conductive cover to define a compartment therebetween. A base seat is disposed in the compartment. An LED lamp device is mounted on the base seat. A heat conductive unit is disposed in the compartment and includes at least one heat conductive pipe and a heat conductive medium flowing within the heat conductive pipe due to a change between a liquid state and a gaseous state thereof. The heat conductive pipe includes a heat exchange portion that absorbs heat generated by the LED lamp device, and a heat-dissipating portion that conducts heat absorbed by the heat exchange portion to the heat conductive cover.

15 Claims, 8 Drawing Sheets

LED LIGHTING FIXTURE

BACKGROUND OF THE INVENTION

1. Field of the Invention

The invention relates to a light emitting diode (LED) lighting fixture, more particularly to an LED lighting fixture capable of dissipating heat generated by an LED lamp device thereof.

2. Description of the Related Art

Referring to FIG. 1, a conventional light emitting diode (LED) lighting fixture comprises a lamp shield 11, a light transmissive cover 12 disposed at a periphery of the lamp shield 11, and an LED lamp device 13 with large power mounted on the lamp shield 11 at a position opposite to the light transmissive cover 12. The LED lamp device 13 can be employed to provide bright illumination. However, the LED lamp device 13 generates a large amount of heat during use. A plastic housing 14 is disposed fixedly on the lamp shield 11, and covers the LED lamp device 13 to protect electronic elements of the LED lamp device 13 from damage. A waterproof enclosure 15 is further disposed around the LED lighting fixture when outdoor use is required.

Since the heat-dissipating ability of plastic material is poor, heat generated by the LED lamp device 13 cannot be dissipated effectively from the LED lighting fixture, thereby reducing the operating efficiency of the LED lighting fixture. Furthermore, the LED lamp device 13 may be damaged as a result of high temperature.

SUMMARY OF THE INVENTION

Therefore, the object of the present invention is to provide a light emitting diode lighting fixture that can dissipate heat effectively.

According to the present invention, there is provided a light emitting diode (LED) lighting fixture that includes a lamp housing including a heat conductive cover, and a light transmissive shield connected detachably to a periphery of the heat conductive cover to define a compartment therebetween. A base seat is disposed in the compartment of the lamp housing. An LED lamp device is mounted on the base seat. A heat conductive unit is disposed in the compartment. The heat conductive unit includes at least one heat conductive pipe and a heat conductive medium flowing within the heat conductive pipe due to a change between a liquid state and a gaseous state thereof. The heat conductive pipe includes a heat exchange portion that absorbs heat generated by the LED lamp device, and a heat-dissipating portion that conducts heat absorbed by the heat exchange portion to the heat conductive cover of the lamp housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
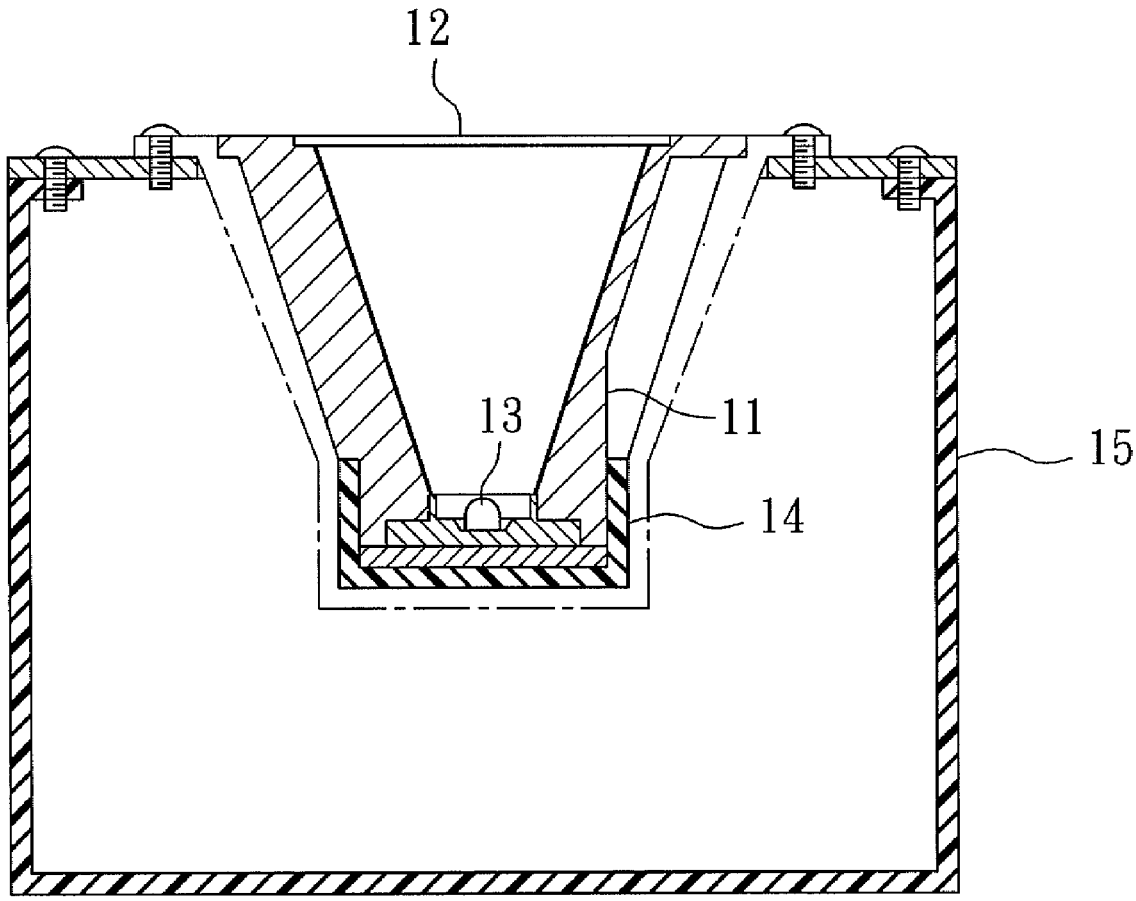
FIG. 1 PRIOR ART
FIG. 1 is a sectional view of a conventional light emitting diode (LED) lighting fixture.

Before the present invention is described in greater detail, it should be noted that like elements are denoted by the same reference numerals throughout the disclosure.

Figure 2:
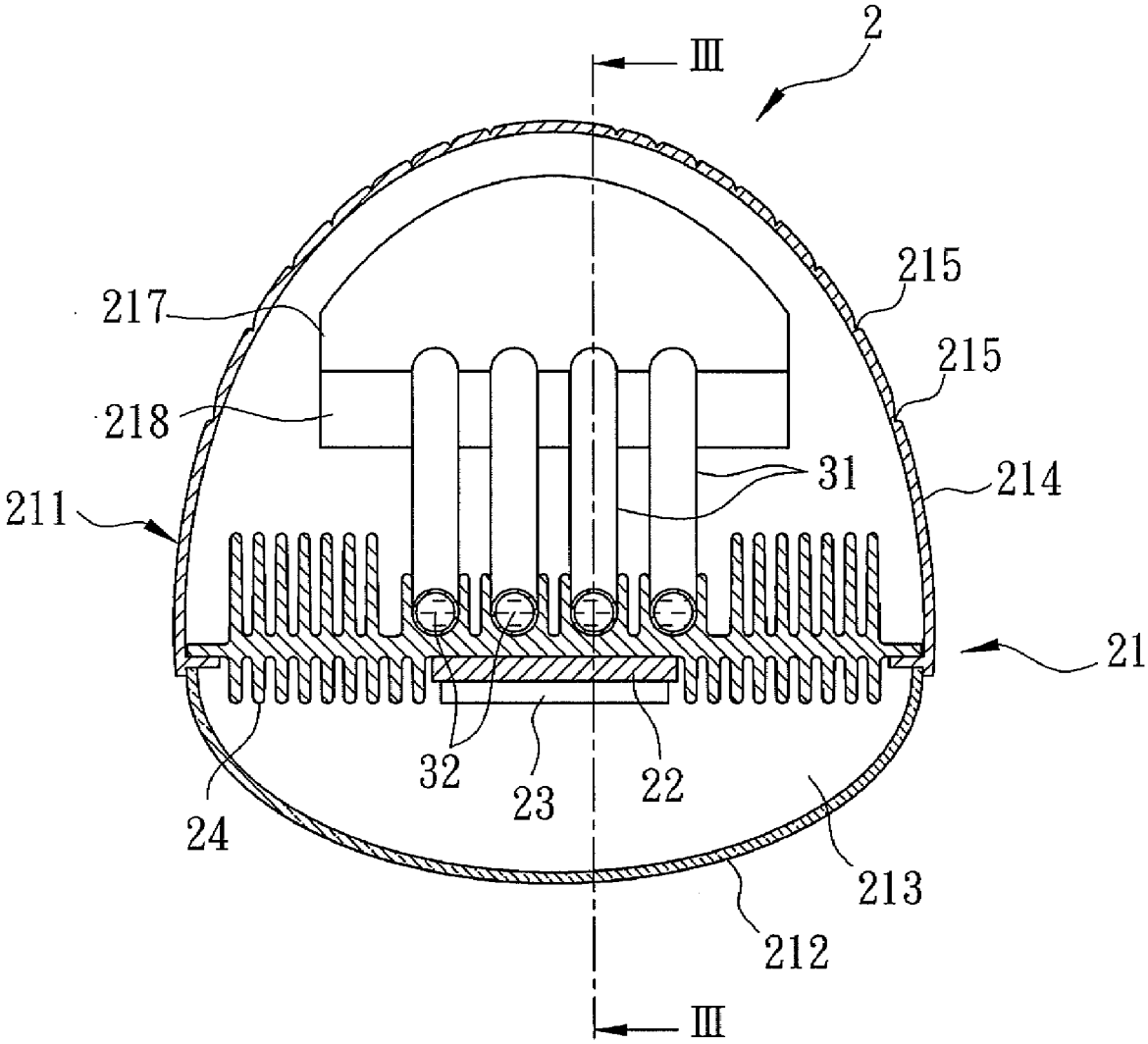
FIG. 2 is a sectional view of an LED lighting fixture of a first preferred embodiment according to the present invention.
Figure 3:
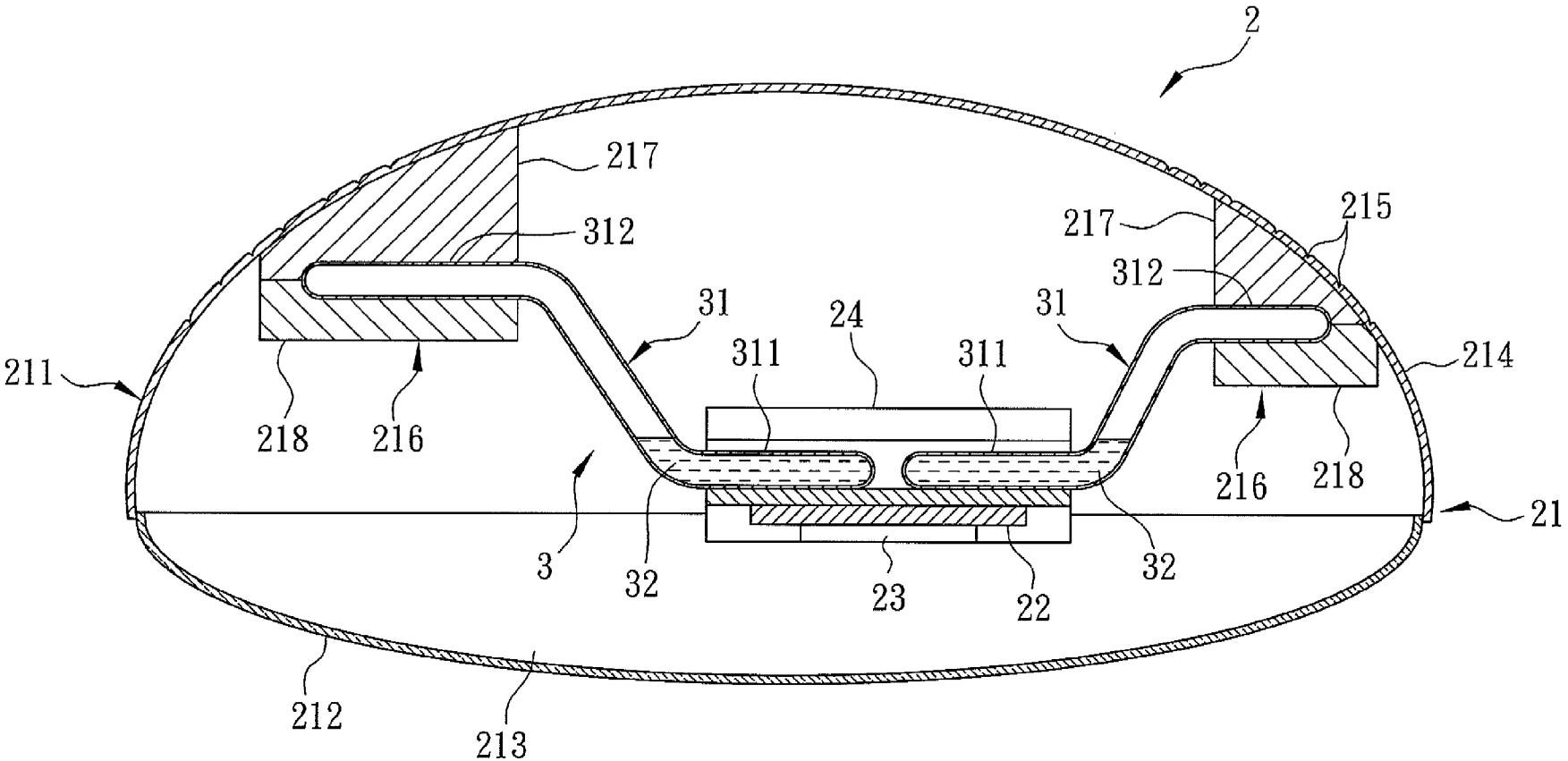
FIG. 3 is a schematic sectional view taken along line III-III in FIG. 2.

FIGS. 2 and 3 show a first preferred embodiment of a light emitting diode (LED) lighting fixture 2 according to the present invention. The LED lighting fixture 2 comprises a lamp housing 21, a base seat 22, an LED lamp device 23, a first heat conductive unit 3, and a heat-dissipating unit 24.

The lamp housing 21 includes a heat conductive cover 211, and a light transmissive shield 212 connected detachably to a periphery of the heat conductive cover 211 to define a compartment 213 therebetween. The base seat 22 is disposed in the compartment 213 of the lamp housing 21. The LED lamp device 23 is mounted fixedly on the base seat 22. The first heat conductive unit 3 is disposed in the compartment 213. The heat conductive cover 211 includes a cover body 214, and two first heat conductive seats 216 mounted fixedly on an inner surface of the cover body 214. An outer surface of the heat conductive cover 211 is formed with a plurality of grooves 215 to increase the heat exchange area. Each of the first heat conductive seats 216 includes an upper heat conductor 217 connected fixedly to the inner surface of the cover body 214, and a lower heat conductor 218 connected detachably to the upper heat conductor 217. The heat-dissipating unit 24 is disposed in the compartment 213, and is connected to the inner surface of the cover body 214. The heat-dissipating unit 24 is shaped as a plurality of fins, thus increasing the heat exchange area to improve the heat-dissipating efficiency. The base seat 22 is made of a heat conductive material and is disposed fixedly on the heat-dissipating unit 24.

The first heat conductive unit 3 includes a plurality of first heat conductive pipes 31 and a heat conductive medium 32 flowing within the first heat conductive pipes 31 due to a change between a liquid state and a gaseous state thereof. Each of the first heat conductive pipes 31 includes a heat exchange portion 311 that absorbs heat generated by the LED lamp device 23, and a heat-dissipating portion 312 that conducts heat absorbed by the heat exchange portion 311 to the heat conductive cover 211 of the lamp housing 21. Each of the heat-dissipating portions 312 of the first heat conductive pipes 31 is inserted into the corresponding first heat conductive seat 216 and between the upper heat conductor 217 and the lower heat conductor 218 of the corresponding first heat conductive seat 216. The heat exchange portions 311 of the first heat conductive pipes 31 are in contact with the heat-dissipating unit 24. The heat-dissipating portions 312 conduct heat absorbed by the heat exchange portions 311 to the heat conductive cover 211 of the lamp housing 21.

In this preferred embodiment, the heat conductive medium 32 is an inorganic superconductor or a volatile liquid material such as methanol, ethanol, and acetone. The heat conductive cover 211 of the lamp housing 21 is made of a lightweight metal, such as aluminum.

It should be noted that the upper heat conductors 217 and the cover body 214 of the heat conductive cover 211 may be formed integrally in other embodiments of this invention.

Since the LED lamp device 23 employed in this preferred embodiment has a large power, a large amount of heat is generated during use. Heat is conducted to the base seat 22 and the heat-dissipating unit 24. The base seat 22 is made of a lightweight metal such as aluminum, for conducting heat to the heat-dissipating unit 24. The heat exchange portions 311 of the first heat conductive pipes 31 of the first heat conductive unit 3 are in contact with the heat-dissipating unit 24 to absorb heat generated by the LED lamp device 23. The heat conductive medium 32 in the first heat conductive pipes 31 absorbs heat and changes from a liquid state to a gaseous state. The gaseous heat conductive medium 32 rises to the heat-dissipating portions 312 and conducts heat exchange with the first heat conductive seats 216. The first heat conductive seats 216 conduct heat exchange with the heat conductive cover 211 to dissipate heat outwardly. Hence, the gaseous heat conductive medium 32 is cooled down, changes into a liquid state, and flows to the heat exchange portions 311 of the first heat conductive pipes 31. The change of the heat conductive medium 32 between liquid and gaseous states is repeated to cool down the LED lighting fixture 2.

To sum up, the advantages of the LED lighting fixture 2 according to the present invention are as outlined in the following. By use of the first heat conductive unit 3 and change of the heat conductive medium 32 between a liquid state and a gaseous state, heat generated by the LED device 23 is dissipated effectively, thereby increasing the heat-dissipating ability and lengthening the service life of the LED lighting fixture 2. The first heat conductive pipes 31 are sealed airtight and enclose the heat conductive medium 32, to allow reuse of the heat conductive medium 32, which is environmentally friendly.

Figure 4:
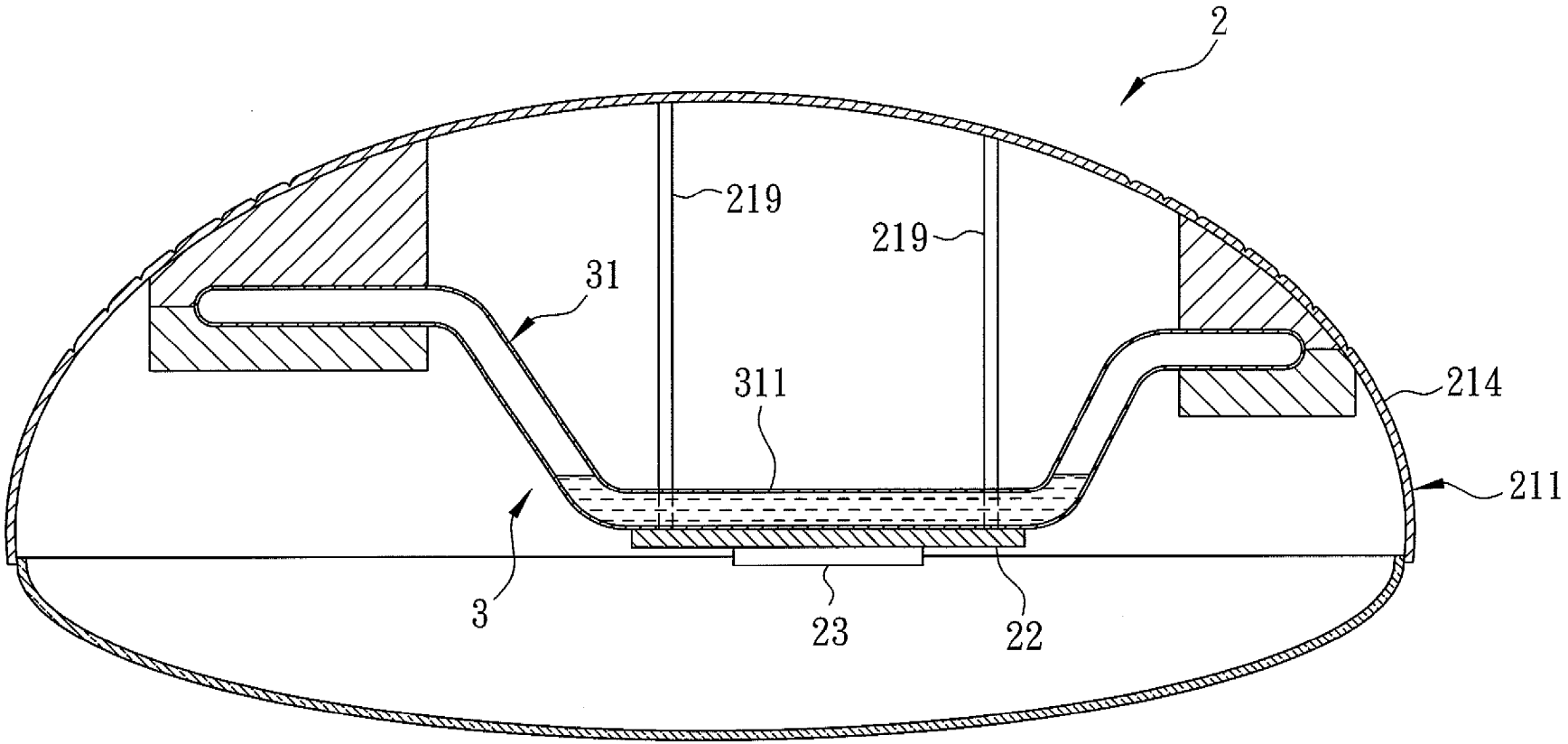
FIG. 4 is a schematic sectional view of an LED lighting fixture of a second preferred embodiment according to the present invention.

Referring to FIG. 4, a second preferred embodiment of an LED lighting fixture 2 according to the present invention has a structure similar to that of the first embodiment. The main difference between this embodiment and the first embodiment resides in the following. A fractional power LED lamp device 23 is employed in this embodiment, thus reducing heat generated by the LED lamp device 23. As a result, the heat-dissipating unit 24 (shown in FIG. 3) may be omitted. Two fastening members 219 extend respectively from the cover body 214 of the heat conductive cover 211 toward the first heat conductive unit 3 to fix the base seat 22 to the cover body 214. The heat exchange portions 311 of the first heat conductive pipes 31 are in contact with the base seat 22. The second preferred embodiment has the same advantages as those of the first preferred embodiment.

Figure 5:
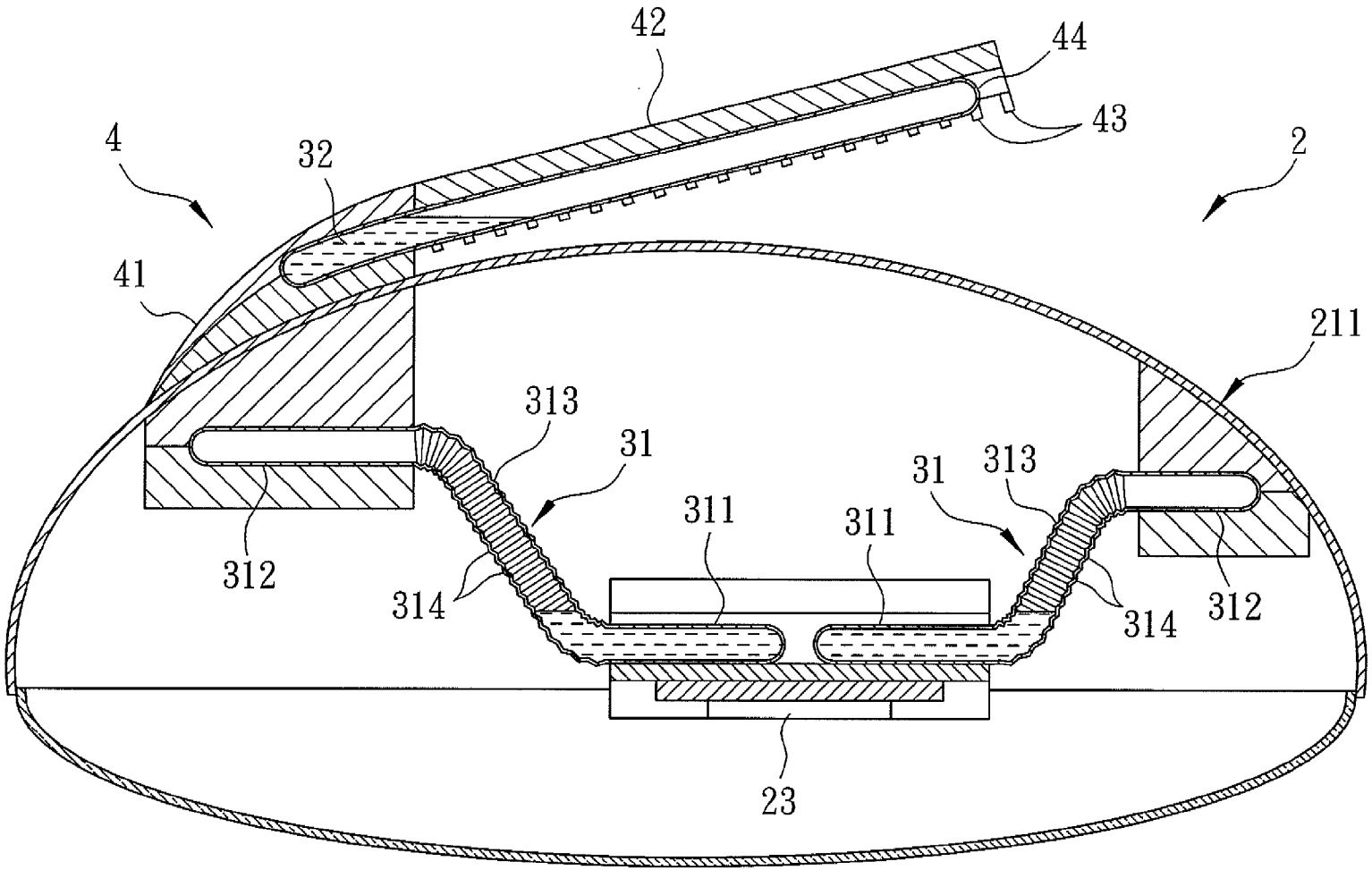
FIG. 5 is a schematic sectional view of an LED lighting fixture of a third preferred embodiment according o the present invention.
Figure 6:
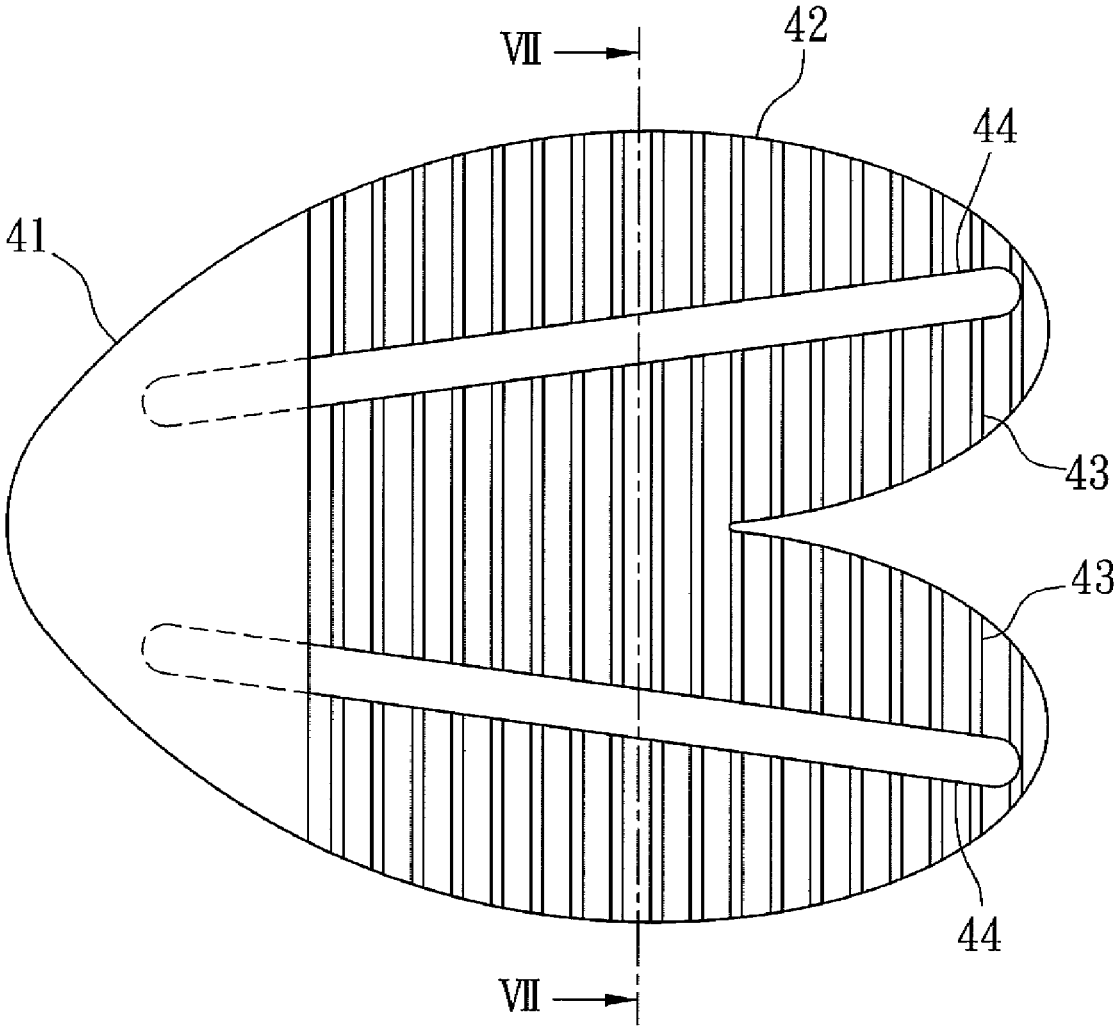
FIG. 6 is a fragmentary bottom view of the LED lighting fixture of the third preferred embodiment, illustrating the configuration of a wing plate and two second heat conductive pipes.

As shown in FIGS. 5 and 6, a third preferred embodiment of an LED lighting fixture 2 according to the present invention has a structure similar to that of the first embodiment. The main difference between this embodiment and the first embodiment resides in the following. The LED lighting fixture 2 further comprises a second heat conductive unit 4. The second heat conductive unit 4 includes a second heat conductive seat 41, a wing plate 42, a plurality of heat-dissipating fins 43, two second heat conductive pipes 44 (see FIG. 6), and a heat conductive medium 32.

Figure 7:
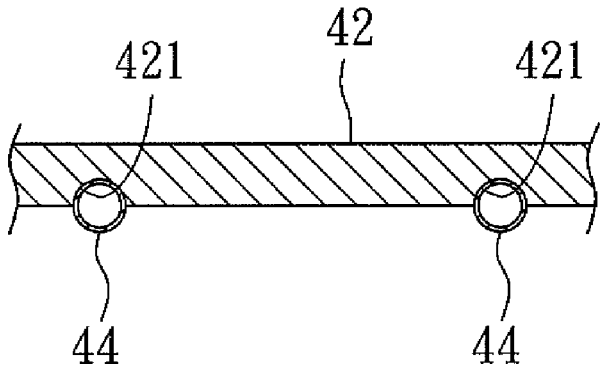
FIG. 7 is a schematic sectional view taken along line VII-VII in FIG. 6, illustrating the two second heat conductive pipes disposed in the wing plate.

The second heat conductive seat 41 is mounted on an outer surface of the heat conductive cover 211. The wing plate 42 is connected to and is in contact with the second heat conductive seat 41, and is spaced apart from the heat conductive cover 211. The second heat conductive pipes 44 are connected to the second heat conductive seat 41 and lean against the wing plate 42. The heat conductive medium 32 flows within the second heat conductive pipes 44 due to a change between a liquid state and a gaseous state thereof. The second heat conductive pipes 44 and the wing plate 42 are inserted into the second heat conductive seat 41. Each of the first heat conductive pipes 31 further includes a middle pipe portion 313 communicated fluidly with the heat-dissipating portion 312 and the heat exchange portion 311 and having an outer surface formed with a plurality of annular grooves 314. Referring to FIG. 7, the wing plate 42 has a bottom surface formed with two pipe-retaining grooves 421. The second heat conductive pipes 44 are disposed respectively in the pipe-retaining grooves 421. Each of the second heat conductive pipes 44 is inserted into the second heat conductive seat 41 at an end thereof. The heat-dissipating fins 43 extend from the wing plate 42 toward the heat conductive cover 211. The second heat conductive pipes 44 extend through the heat-dissipating fins 43.

Heat generated by the LED device 23 is further conducted to the second heat conductive seat 41. The heat conductive medium 32 in the second heat conductive pipes 44 absorbs heat and changes from a liquid state to a gaseous state. The gaseous heat conductive medium 32 rises to a position opposite to the second heat-dissipating seat 41 and conducts heat exchange with the heat-dissipating fins 43. The heat-dissipating fins 43 are provided to increase the heat exchange area to thereby dissipate heat outwardly and effectively. The third preferred embodiment has the same advantages as those of the first preferred embodiment. In this preferred embodiment, the heat conductive medium 32 is an inorganic superconductor or a volatile liquid material such as methanol, ethanol, and acetone.

Figure 8:
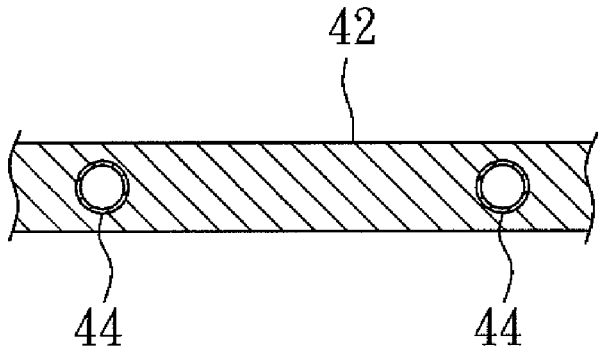
FIG. 8 is a schematic sectional view, illustrating a modified configuration of two second heat conductive pipes embedded in the wing plate.

The configuration of the second heat conductive pipes 44 and the wing plate 42 may be modified in other embodiments of this invention. As shown in FIG. 8, the wing plate 42 of the second heat conductive unit 4 has top and bottom surfaces. The second heat conductive pipes 44 are embedded in the wing plate 42 and are disposed between and spaced apart from the top and bottom surfaces of the wing plate 42. Each of the second heat conductive pipes 44 is inserted into the second heat conductive seat 41 at an end thereof.

Figure 9:
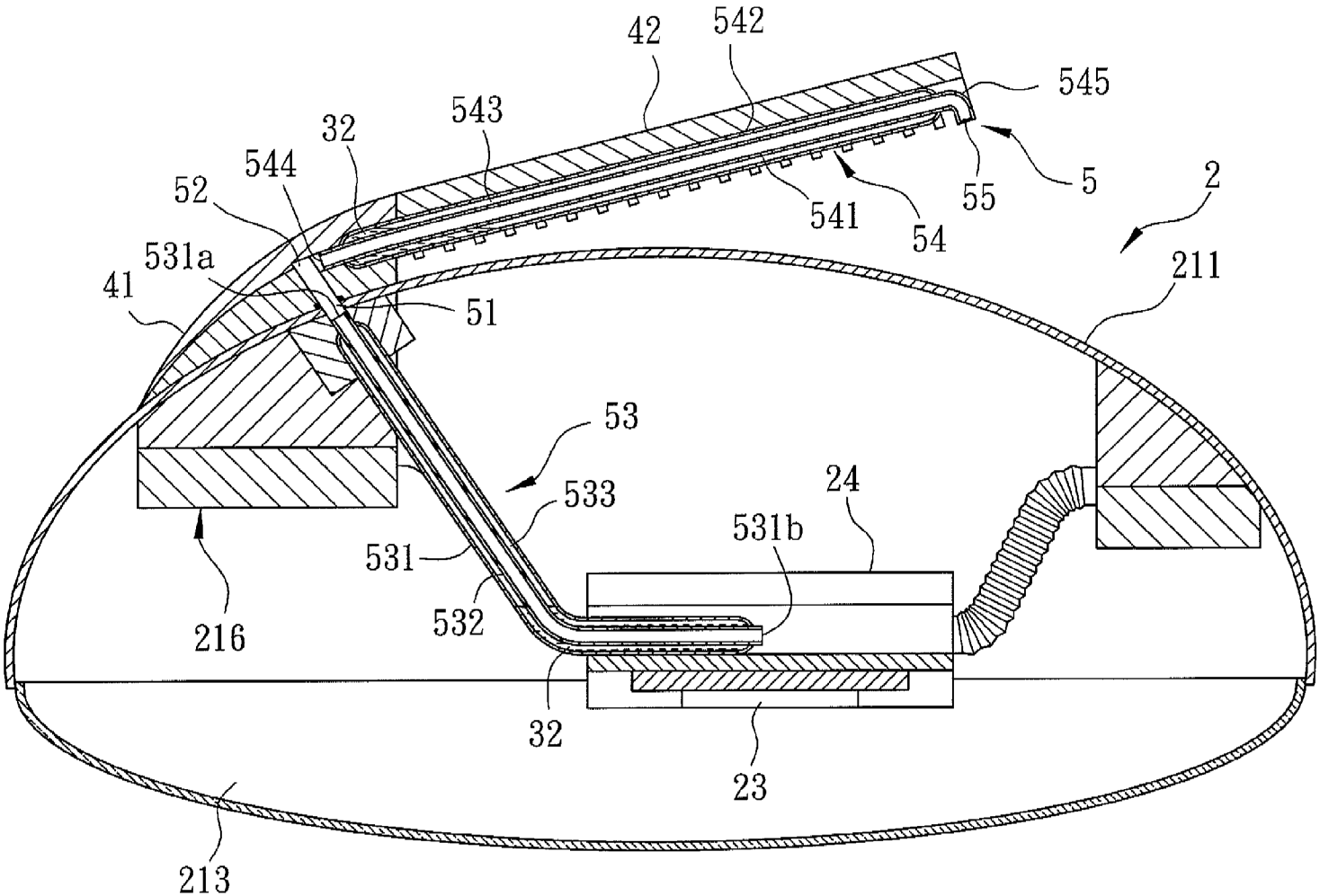
FIG. 9 is a sectional view of an LED lighting fixture of a fourth preferred embodiment according to the present invention.

As shown in FIG. 9, a fourth preferred embodiment of the LED lighting fixture 2 according to the present invention has a structure similar to that of the third embodiment. The main difference between this embodiment and the third embodiment resides in the following. The LED lighting fixture 2 further comprises a convection unit 5. The convection unit 5 includes a first convection passage 51, a second convection passage 52, two first convection tubes 53 (only one is shown), and two second convection tubes 54 (only one is shown). The first convection passage 51 is formed in one of the first heat conductive seats 216 that is proximate to the second heat conductive seat 41. The second convection passage 52 is formed in the second heat conductive seat 41 and is in fluid communication with the first convection passage 51. The first convection tubes 53 are disposed in the compartment 213 and are in fluid communication with the first convection passage 51 and the compartment 213. The second convection tubes 54 are disposed between the heat conductive cover 211 and the wing plate 42. The second convection tubes 54 are in fluid communication with the second convection passage 52 and ambient surroundings. Each of the first convection tubes 53 includes a first inner tube body 531 having a first open end 531*a* in fluid communication with an end of the first convection passage 51, and a second open end 531*b* in fluid communication with the compartment 213, a first outer tube body 532 disposed around the first inner tube body 531 to define an elongated first convection chamber 533 therebetween, and a heat conductive medium 32 flowing within the first convection chamber 533 due to a change between a liquid state and a gaseous state thereof. Each of the second convection tubes 54 includes a second inner tube body 541 having a first open end 544 in fluid communication with an end of the second convection passage 52, and a second open end 545 exposed outwardly of the wing plate 42 and in fluid communication with ambient surroundings, a second outer tube body 542 disposed around the second inner tube body 541 to define an elongated second convection chamber 543 therebetween, and a heat conductive medium 32 that flows within the second convection chambers 543 due to a change between a liquid state and a gaseous state thereof.

Each of the first open ends 531*a* of the first inner tube bodies 531 of the first convection tubes 53 is press-fitted into the first convection passage 51. Each of the second open ends 531*b* of the first inner tube bodies 531 is in contact with the heat-dissipating unit 24 of the first heat conductive unit 3. Each of the first open ends 544 of the second inner tube bodies 541 of the second convection tubes 54 is press-fitted into the second convection passage 52. Each of the second open ends 545 of the second inner tube bodies 541 is bent toward the heat conductive cover 211. The convection unit 5 further includes two filtering nets 55 disposed respectively at the second open ends 545 of the second inner tube bodies 541 to therefore prevent external articles from moving into the compartment 213 via the second inner tube bodies 541.

Air in the compartment 213 is heated up by the LED lamp device 23, and flows through the first inner tube bodies 531, the first convection passage 51, the second convection passage 52, and exits from the second open ends 545 of the second inner tube bodies 541. As such, the temperature of the LED lighting fixture 2 can be further decreased. The fourth preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting diode (LED) lighting fixture comprising:

a lamp housing including a heat conductive cover, and a light transmissive shield connected detachably to a periphery of said heat conductive cover to define a compartment therebetween;

a base seat disposed in said compartment of said lamp housing;

an LED lamp device mounted on said base seat; and a first heat conductive unit disposed in said compartment, said first heat conductive unit including at least one first heat conductive pipe and a heat conductive medium flowing within said first heat conductive pipe due to a change between a liquid state and a gaseous state thereof, said first heat conductive pipe including a heat exchange portion that absorbs heat generated by said LED lamp device, and a heat-dissipating portion that conducts heat absorbed by said heat exchange portion to said heat conductive cover of said lamp housing;

wherein said heat conductive cover includes a cover body, and at least one first heat conductive seat mounted fixedly on an inner surface of said cover body, said heat-dissipating portion of said first heat conductive pipe being inserted into said first heat conductive seat; and wherein said first heat conductive seat includes an upper heat conductor connected fixedly to said inner surface of said cover body, and a lower heat conductor connected detachably to said upper heat conductor, said heat-dissipating portion of said first heat conductive pipe being inserted between said upper heat conductor and said lower heat conductor of said first heat conductive seat, said heat exchange portion of said first heat conductive pipe being in contact with said base seat.

2. The LED lighting fixture as claimed in claim 1, wherein said first heat conductive unit further includes a heat-dissipating unit disposed in said compartment, and connected to said inner surface of said cover body, said base seat being made of a heat conductive material and being disposed fixedly on said heat-dissipating unit.

3. The LED lighting fixture as claimed in claim 1, wherein an outer surface of said heat conductive cover is formed with a plurality of grooves.

4. A light emitting diode (LED) lighting fixture comprising:

a lamp housing including a heat conductive cover, and a light transmissive shield connected detachably to a periphery of said heat conductive cover to define a compartment therebetween;

a base seat disposed in said compartment of said lamp housing;

an LED lamp device mounted on said base seat; and a first heat conductive unit disposed in said compartment, said first heat conductive unit including at least one first heat conductive pipe and a heat conductive medium flowing within said first heat conductive pipe due to a change between a liquid state and a gaseous state thereof, said first heat conductive pipe including a heat exchange portion that absorbs heat generated by said LED lamp device, and a heat-dissipating portion that conducts heat absorbed by said heat exchange portion to said heat conductive cover of said lamp housing;

wherein said heat conductive cover includes a cover body, and at least one first heat conductive seat mounted fixedly on an inner surface of said cover body, said heat-dissipating portion of said first heat conductive pipe being inserted into said first heat conductive seat;

wherein said first heat conductive unit further includes a heat-dissipating unit disposed in said compartment, and connected to said inner surface of said cover body, said base seat being made of a heat conductive material and being disposed fixedly on said heat-dissipating unit; and wherein said first heat conductive seat includes an upper heat conductor connected fixedly to said inner surface of said cover body, and a lower heat conductor connected detachably to said upper heat conductor, said heat-dissipating portion of said first heat conductive pipe being inserted between said upper heat conductor and said lower heat conductor of said first heat conductive seat, said heat exchange portion of said first heat conductive pipe being in contact with said heat-dissipating unit.

5. The LED lighting fixture as claimed in claim 4, wherein an outer surface of said heat conductive cover is formed with a plurality of grooves.

6. The LED lighting fixture as claimed in claim 4, further comprising a second heat conductive unit, said second heat conductive unit including a second heat conductive seat mounted on an outer surface of said heat conductive cover, at least one heat conductive wing plate connected to and in contact with said second heat conductive seat and spaced apart from said heat conductive cover, at least one second heat conductive pipe connected to said second heat conductive seat and leaning against said wing plate, and a heat conductive medium flowing within said second heat conductive pipe due to a change between a liquid state and a gaseous state thereof, said second heat conductive pipe and said wing plate being inserted into said second heat conductive seat.

7. The LED lighting fixture as claimed in claim 6, wherein said first heat conductive pipe further includes a middle pipe portion being communicated fluidly with said heat-dissipating portion and said heat exchange portion and having an outer surface formed with a plurality of annular grooves.

8. The LED lighting fixture as claimed in claim 7, wherein said wing plate of said second heat conductive unit has a bottom surface formed with a pipe-retaining groove, said second heat conductive pipe being disposed in said pipe-retaining groove, said second heat conductive pipe being inserted into said second heat conductive seat at an end thereof.

9. The LED lighting fixture as claimed in claim 8, wherein said second heat conductive unit further includes a plurality of heat-dissipating fins extending from said wing plate toward said heat conductive cover, said second heat conductive pipe extending through said heat-dissipating fins.

10. The LED lighting fixture as claimed in claim 9, further comprising a convection unit, said convection unit including a first convection passage formed in said first heat conductive seat, a second convection passage formed in said second heat conductive seat and being in fluid communication with said first convection passage, at least one first convection tube disposed in said compartment and being in fluid communication with said first convection passage and said compartment, and at least one second convection tube disposed between said heat conductive cover and said wing plate, and being in fluid communication with said second convection passage and ambient surroundings.

11. The LED lighting fixture as claimed in claim 10, wherein said first convection tube includes a first inner tube body having a first open end in fluid communication with an end of said first convection passage, and a second open end in fluid communication with said compartment, a first outer tube body disposed around said first inner tube body to define an elongated first convection chamber therebetween, and a heat conductive medium flowing within said first convection chamber due to a change between a liquid state and a gaseous state thereof, said second convection tube including a second inner tube body having a first open end in fluid communication with an end of said second convection passage, and a second open end exposed outwardly of said wing plate and in fluid communication with ambient surroundings, a second outer tube body disposed around said second inner tube body to define an elongated second convection chamber therebetween, and a heat conductive medium flowing within said second convection chamber due to a change between a liquid state and a gaseous state thereof.

12. The LED lighting fixture as claimed in claim 11, wherein said first open end of said first inner tube body of said first convection tube is press-fitted into said first convection passage, and said second open end of said first inner tube body is in contact with said heat-dissipating unit of said first heat conductive unit, said first open end of said second inner tube body of said second convection tube being press-fitted into said second convection passage, said second open end of said second inner tube body being bent toward said heat conductive cover.

13. The LED lighting fixture as claimed in claim 12, wherein said convection unit further includes a filtering net disposed at said second open end of said second inner tube body.

14. The LED lighting fixture as claimed in claim 7, wherein said wing plate of said second heat conductive unit has top and bottom surfaces, said second heat conductive pipe being embedded in said wing plate and being disposed between and spaced apart from said top and bottom surfaces of said wing plate, said second heat conductive pipe being inserted into said second heat conductive seat at an end thereof.

15. The LED lighting fixture as claimed in claim 14, wherein said second heat conductive unit further includes a plurality of heat-dissipating fins extending from said wing plate toward said heat conductive cover.

* * * * *